United States Patent [19]

Pace

[11] 3,987,839

[45] Oct. 26, 1976

[54] NEEDLE APPARATUS AND METHOD FOR MAKING NEEDLE APPARATUS

[76] Inventor: Robert K. Pace, 10206 Arvilla NE., Albuquerque, N. Mex. 87111

[22] Filed: Sept. 24, 1975

[21] Appl. No.: 616,505

[52] U.S. Cl. ..... 163/5; 223/102

[51] Int. Cl.[2] ..... B21G 1/00

[58] Field of Search ..... 163/1, 5; 223/102, 103, 223/104, 99

[56] References Cited

UNITED STATES PATENTS

| | | | |
|---|---|---|---|
| 386,723 | 7/1888 | Smith | 223/102 |
| 1,151,873 | 8/1915 | Graham | 223/103 |
| 2,167,080 | 7/1939 | Mason | 223/99 |
| 2,448,432 | 8/1948 | Huning | 223/99 |
| 2,716,515 | 8/1955 | Moghadam | 223/102 |
| 2,758,648 | 8/1956 | Dodds | 163/5 |

*Primary Examiner*—Granville Y. Custer, Jr.
*Attorney, Agent, or Firm*—H. Gordon Shields

[57] ABSTRACT

Needle apparatus is disclosed which includes a pair of flexible members secured together at the ends of the members and biased together but separable apart to provide an eye for the needle which is substantially the length of the needle.

4 Claims, 4 Drawing Figures

NEEDLE APPARATUS AND METHOD FOR MAKING NEEDLE APPARATUS

BACKGROUND OF THE INVENTION

1. Field of the Invention

This invention relates to needles, and, more particularly, to needles for sewing and for stringing which includes an eye which is substantially the length of the needle.

2. Description of the Prior Art The proverbial "eye of a needle" has provided problems for those who use needles to sew and to thread objects for a time span which is probably about equal to that of the existence of needles. There are many types of needles, each of which is designed for a specific use, such as relatively small needles used with thread for ordinary sewing, somewhat larger needles with larger eyes, and usually blunted points, used for crewel and the like, larger needles, usually curved, for use in upholstery work, and longer type needles used for stringing beads and the like. Obviously, there are many other types of needles for specialized use, such as for surgery, preparing canvas, and the like. Moreover, there are many types of machine needles, such as used for ordinary household sewing, commercial sewing, leather working, tent and sail making, and the like. However, with respect to the types of needles encountered in normal household usage, there are basic similarities, such as relatively short and thin needles used for ordinary sewing, larger needles which may be used for crewel and the like, and perhaps longer and curved needles used for upholstery or stringing purposes.

Most needle users have problems in threading a needle. As a person gets older, the problem of farsightedness increases and it is increasingly difficult to accommodate the vision to focus properly on a needle eye. Moreover, physical ailments, such as shaking of hands or fingers or arthritic problems also increase the problems inherent in threading needles. With use of different size threads, problems can also increase when trying to use one or two needles with various sizes of threads. The use of yarn, such as in crewel, also causes problems with respect to threading ordinary needles. Obviously, the list of problems increases with the various uses one applies to needles and with the different sizes and types of threads or yarns. Since these problems are not new, attempts have been made in the past to solve some of the problems, such as using needles with elongated eyes, split needles, and the like. Such examples of attempts to solve some of the problems will be discussed below with reference to specific patents.

U.S. Pat. No. 386,723 (Smith) discloses a needle made of a single piece of wire doubled upon itself and twisted throughout its entire length. Throughout the length, at certain intervals thereon, are open portions comprising eyes. The wire is appropriately soldered to secure it together and to form a point. The purpose of this needle is for use with wax cord, such as in shoe making or harness making. The waxed cord was first passed through one of the eyes, then wrapped around the needle and passed through an adjacent eye, etc. This apparatus was designed for a specific use, and is not adaptable to household use. For example, the eyes are substantially larger than the diameter of the needle to accommodate specific waxed thread. Moreover, multiple eyes are required, again to meet a specific purpose.

U.S. Pat. No. 568,418 (Strain) discloses split needles of several designs, but each of which includes an enlarged diameter portion. A portion of the needle is split to accommodate a thread therethrough. The slot or split in the portion of the needle receives the thread to be used with the needle. This type of needle is expensive to manufacture and, due to the particular design, is particularly adapted for sewing machine use. Only one portion of the needle eye is flexible and moves to allow the insertion of thread. The method of making the split needle, and the results obtained thereby, would not lend itself to use in a sewing situation where it is desired to pass the entire needle through the cloth due to the juncture of the split portion with the rest of the needle body. That is, the needle body would snag at the juncture of the slit portion so as to cause problems in the sewing process.

U.S. Pat. No. 1,070,941 (Bell) discloses another type of split needle which is somewhat similar to the needle apparatus of the '418 (Strain) patent. In this patent a portion of the needle is split to allow a thread to be inserted therein. However, the split portion has the same inherent problem with respect to drawing the needle through cloth as does U.S. Pat. No. 568,418. The juncture of the split portion with the body of the needle causes snags and the like and is accordingly not practical for household purposes. Moreover, the snag problem increases as the diameter of the thread used by the apparatus increases.

U.S. Pat. No. 2,167,080 (Mason) discloses needle threading apparatus which illustrated a threader having two wire portions joined to form a thread receiving loop or slot. Several embodiments are disclosed. The needle threader discloses primarily two wires, each of different diameter, joined together at the ends to form a single threading apparatus which may be spread apart to receive a thread which in turn is inserted through a needle of a conventional type. The patent also discloses another embodiment of the apparatus which is made by slotting a resilient metal bar inwardly from the ends of the bar. This results in a relatively flexible center portion and in relatively inflexible end portions.

U.S. Pat. No. 2,758,648 (Dodds) discloses needles formed of a length of wire, bent on itself and secured together, as by welding, to form a unitary needle with an elongated eye portion. The resulting needle is sufficiently resilient to spread apart to receive a thread and yet is of sufficient rigidity to be used as a needle. However, the doubled over portion or elongated eye of the needle appears to be permanently spread apart and is accordingly not flexible enough to maintain a hold or grip on the needle throughout the length of the eye. That is, the needle provides a permanently elongated eye rather than a biased eye throughout the length of the needle, which may be spread apart to receive a thread but which has sufficient bias to inherently hold a thread in the eye.

Another embodiment of the needle discloses a portion of the elongated eye comprising three segments. In addition to the continuous outer portion of the eye, there is a flexible center member secured only at one end of the member which is adapted to receive and hold the thread when the center portion is spread apart from the eye portion.

SUMMARY OF THE INVENTION

The invention disclosed and claimed herein comprises a needle formed of a pair of wires secured together at opposite ends and slightly twisted, which, when spread apart, provides an eye which is substantially the length of the needle, and when released, is inherently biased together to securely hold the thread inserted therein.

Among the objects of the invention are the following:

To provide new and useful needle apparatus;

To provide new and useful needle apparatus having an elongated eye portion;

To provide new and useful needle apparatus made of a pair of wires; and

To provide new and useful needle apparatus having an eye which is inherently biased to hold thread therein.

DESCRIPTION OF THE PREFERRED EMBODIMENT

Figure 1:
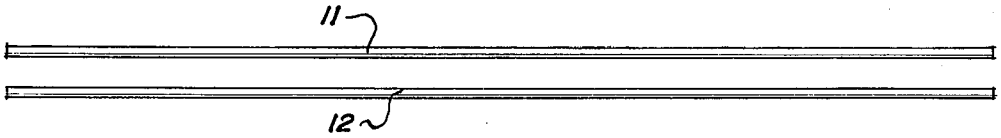
FIG. 1 is a view of two elements of the needle of the present invention prior to being secured together to comprise the needle.

FIG. 1 is a view of a pair of wires 11 and 12 which, when appropriately secured together will comprise a needle. The wires are substantially the same length and diameter. Music wire, such as straightened piano wire, which is a high carbon steel, of low ductility, is preferable due to its inherent characteristics. With low ductility, the wire will not stretch readily, but the wire will flex. Depending on the length of the needle, and the strength of the needle required, the diameter of the wire may vary. However, for most purposes, a diameter of about 10 1,000ths of an inch (0.010 inch or 0.254 mm.) and the diameter of the completed needle will accordingly be about twice that of each wire, or about 20 1,000ths of an inch (0.020 inch or 0.508 mm.), overall. while the term "diameter" is used, it is obvious that any particular cross section of a needle will be elliptical, with a major diameter of 0.020 inches, and a minor diameter of 0.010 inches (0.508 mm. x 0.254 mm.).

Figure 2:
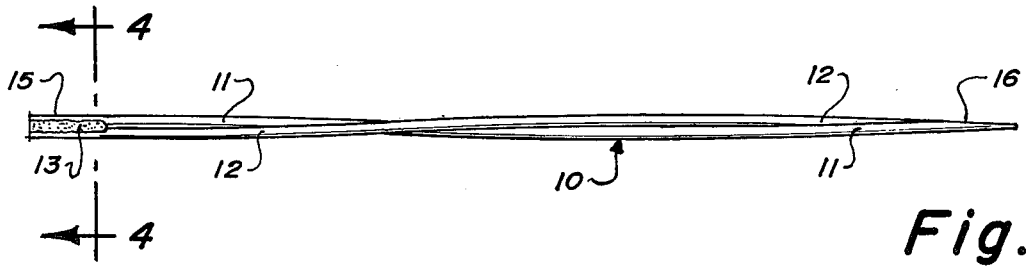
FIG. 2 is a view of the needle of the present invention comprising the elements of FIG. 1 after the elements have been secured together.

FIG. 2 is a view of the wires 11 and 12 of FIG. 1 after the wires have been appropriately secured together and fashioned into a needle 10, with a blunt end 15 and a pointed end 16. The wires 11 and 12 are secured together at both ends with an appropriate material, such as silver solder or a brazing compound 13. The brazing or soldering is accomplished after a twist has been given to the wires, as illustrated in FIG. 2. One end of the needle is soldered or brazed and appropriately polished or smoothed so as to prevent ragged or jagged edges at the juncture of the two wires, and the end of the needle is left blunt to define the blunt end 15. As shown in FIG. 1, the brazing compound extends only a short distance from the outer or distal ends of the two wires, which distal ends refer to the ends of the wires at the blunt end 15 of the needle, as opposed to the forward sharp or pointed end of the needle, as illustrated by reference numeral 16 in FIGS. 2 and 3. If desired, both ends of a needle may be pointed to facilitate the use of the needle for stringing beads and the like.

At the sharp or pointed forward end of the needle the wires are also soldered or brazed for a short distance, and the front or forward portion of the wires 11 and 12 are similarly polished or appropriately ground to a point to define the pointed end 16. During the polishing or grinding process, both the needles and the soldering or brazing compound are polished or smoothed together. If desired, the point 16 may be configured to define a ball point for use of the needle with man-made fibers, for crewel, and the like.

Figure 3:
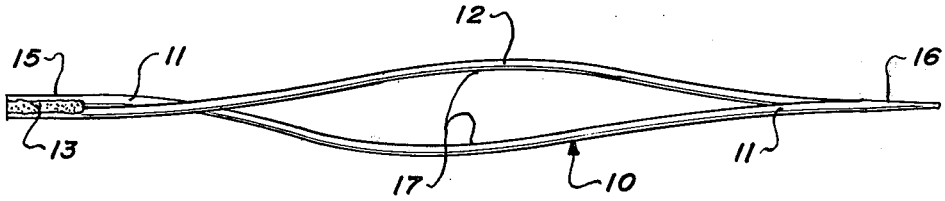
FIG. 3 is a view of the needle apparatus of FIG. 2 with the elements spread apart to define an eye.

As illustrated in FIG. 2, and also in FIG. 3, the two wires 11 and 12, which together comprise the needle 10, include a three-quarter twist between the blunt end 15 and the pointed end 16. The twist may be greater or lesser than the illustrated three-quarters. The greater the twist, the greater the rigidity of the needle. If desired, the needle may also be gently curved, as for use with upholstery and tacking. The needles of the present invention may also be made of any appropriate length.

FIG. 3 is a view of the needle apparatus 10 of FIG. 2 with the wire elements 11 and 12 spread apart between the blunt end 15 and the point or pointed end 16 to defne an eye 17. The twist, comprising a three-quarter turn in the wires 11 and 12, discussed above, is illustrated in FIG. 3 as remaining in the position shown in FIG. 2 even though the wire elements are spread apart to define the eye 17. In addition to the increase in strength in the needle itself imparted by the twist, the twist also gives or adds to the bias of the wires to close the eye which in turn biases a thread extending through the needle to hold the thread frictionally in place in the eye of the needle. While the needle in and of itself includes an inherent bias to remain in the closed position, with the two wire elements 11 and 12 juxtaposed against each other, the twist of wire elements as illustrated increases the bias.

Figure 4:
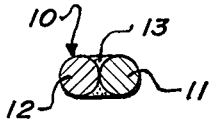
FIG. 4 is a view of the needle apparatus of FIG. 2 taken generally along line 4—4 thereof.

FIG. 4 is a view of the needle apparatus of FIG. 2 taken generally along line 4—4 of FIG. 2. The wire elements 11 and 12 are shown in section, and the solder or brazing compound 13 is also sectioned. In FIG. 4, the two wires 11 and 12 are juxtaposed against each other with the solder or brazing compound 13 extending therebetween and securing the two wires together.

The elliptical cross section of the needle apparatus 10 at any particular point is clearly illustrated in FIG. 4. The total width of the cross section is the sum of the diameter of each of the wires 11 and 12, and this distance comprises the major diameter of the ellipse which defines the cross section. The minor diameter is the diameter of the individual wires 11 and 12. With the brazing or soldering compound 11, the ellipse is substantially complete. However, if a cross section of the needle apparatus were taken other than at the blunt end or at the point where the wires have been soldered or brazed together, obviously the ellipse would not be complete in that the area between the point of tangency of the two wires outwardly would not be filled in. However, for all practical purposes, with respect to the use of the apparatus, the cross sectional area would have both a major diameter and a minor diameter.

As illustrated in FIG. 1 and also in FIG. 4, the wires 11 and 12 are of the same diameter and, as discussed above, are substantially alike not only in dimensions, but also in other properties.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operating requirements, without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. A method of making a needle, comprising, in combination, the steps of:

selecting a pair of wires of substantially equal dimensions;

juxtaposing the wires of the pair against each other;

twisting the pair of juxtaposed wires between their respective ends; and securing together the ends of the pair of wires.

2. The method of claim 1 which includes the step of sharpening one end of the pair of wires to define a pointed end of the needle.

3. A needle, comprising, in combination:

a first wire having a first end and a second end spaced apart from each other;

a second wire, having a first end and a second end spaced apart from each other and having substantially the same dimensions as the first wire;

the first and second wires juxtaposed against each other with the first ends and the second ends of the respective wires secured together and with a twist in the wires extending between the first ends as secured together and the second ends as secured together;

the first and second wires defining an eye of the needle when spread apart; and the twist in said wires providing a bias to close the said eye of the needle.

4. The needle of claim 3 in which the twist in the wires is uniform between the first and the second ends of the needle.

* * * * *